US006216750B1

(12) United States Patent
Braun et al.

(10) Patent No.: US 6,216,750 B1
(45) Date of Patent: Apr. 17, 2001

(54) WEAVING LOOM PANEL SUPPORT STRUCTURE FOR JACQUARD SELECTORS

(75) Inventors: Dominique Braun, Faverges; Pierre Bourgeaux, Poisy, both of (FR)

(73) Assignee: Staubli Faverges, Faverges (FR)

( * ) Notice: Subject to any disclaimer, the term of this patent is extended or adjusted under 35 U.S.C. 154(b) by 0 days.

(21) Appl. No.: 09/575,752

(22) Filed: May 22, 2000

(30) Foreign Application Priority Data

May 31, 1999 (FR) ..... 99 07029

(51) Int. Cl.[7] ..... D03C 3/20; D03C 13/00
(52) U.S. Cl. ..... 139/455
(58) Field of Search ..... 139/455

(56) References Cited

U.S. PATENT DOCUMENTS

| | | | | |
|---|---|---|---|---|
| 3,733,855 | * | 5/1973 | Bliss-hill et al. | 66/50 R |
| 4,936,357 | * | 6/1990 | Keim et al. | 139/455 |
| 5,125,435 | * | 6/1992 | Froment | 139/455 |
| 5,176,186 | * | 1/1993 | Bousfield et al. | 139/455 |
| 5,462,097 | | 10/1995 | Skalka . | |
| 6,050,305 | | 4/2000 | Braun et al. . | |
| 6,058,983 | | 5/2000 | Bourgeaux et al. . | |
| 6,092,564 | | 7/2000 | Bourgeaux et al. . | |
| 6,105,629 | | 8/2000 | Braun et al. . | |
| 6,105,630 | | 8/2000 | Braun et al. . | |

FOREIGN PATENT DOCUMENTS

| | | |
|---|---|---|
| 0304985 | 3/1989 | (EP) . |
| 0536899 | 4/1993 | (EP) . |
| 2680526 | 2/1993 | (FR) . |
| 8701142 | 2/1987 | (WO) . |
| 9409197 | 4/1994 | (WO) . |

OTHER PUBLICATIONS

Copy of pending application, Serial No. 09/218,300 filed Dec. 27, 1998, Braun et al., entitled Electrical Rotating Actuator for Forming the Shed on a Weaving Loom and Process of Manufacturing Thereof, Weaving System and Weaving Loom.

European Patent Office, Patents Abstracts of Japan, 01292135, 11/24/99, Murata Mach Ltd., Nakajima Toshio, Dobby Machine.

* cited by examiner

*Primary Examiner*—Andy Falik
(74) *Attorney, Agent, or Firm*—Dowell & Dowell, P.C.

(57) ABSTRACT

A loom and a weaving mechanism of the Jacquard type for forming the shed in the loom wherein the weaving mechanism is associated with a harness including harness cords secured to heddles. The harness cords are controlled by electric actuators mounted to two panels extending above the heddles and between which a compartment is formed in which a control unit for supplying and monitoring the operation of the actuators is housed.

12 Claims, 3 Drawing Sheets

WEAVING LOOM PANEL SUPPORT STRUCTURE FOR JACQUARD SELECTORS

BACKGROUND OF THE INVENTION

1. Field of the Invention

The present invention relates to machines used for forming the shed in weaving looms, and more particularly to weaving mechanisms of the Jacquard type. The invention also relates to a weaving loom equipped with such a mechanism.

2. Brief Discussion of the Related Art

In their conventional construction, Jacquard mechanisms comprise a head actuation device, placed above the loom, and a harness connecting this head to the warp yarns stretched on the loom. This harness comprises a series of harness cords directly and individually controlled by the head in a vertical movement of displacement. Each of the harness cords is assembled by a collar on one or more heddles, each heddle bearing a mail traversed by a warp yarn.

The known devices most often comprise griffe frames bearing griffes or knives intended to raise, or not, hooks kinematically linked to the harness cords. The fact of driving these griffe frames with a vertical reciprocating movement requires the use of an elaborate mechanical transmission, from the central shaft of the loom, while the precision of the shed obtained depends on the mechanical clearances of this kinematic assembly. The known mechanical devices are complex and not readily accessible, which is detrimental to assembly and maintenance thereof.

It is an object of the present invention to overcome the limitations set forth above by proposing a weaving mechanism and a weaving loom which are compact, economical and easily accessible, thus facilitating use thereof.

SUMMARY OF THE INVENTION

To that end, the invention relates to a weaving mechanism of the Jacquard type for forming the shed in a weaving loom, this mechanism being associated with a harness comprising harness cords, secured to heddles associated with the warp yarns of the loom, characterized in that the harness cords are controlled by electric actuators arranged in rows and/or in columns forming two panels disposed above the loom, and in that a unit for supplying and monitoring these actuators is housed in a compartment defined between these panels.

Thanks to the invention, it is possible for the panels formed by these actuators and the unit for supplying and monitoring these actuators, to cohabit in a compact and economical assembly which is easy to access for the operations of assembly and maintenance of the weaving loom. The compartment thus formed efficiently protects the supply and monitoring unit from its environment, particularly from mechanical shocks and dust or surrounding fluff.

According to advantageous but optional aspects of the invention, the mechanism incorporates one or more of the following features:

Two plates arranged at the ends of the panels border the compartment, one of these plates supporting means monitoring the temperature of this compartment and/or of the actuators. In that case, the temperature monitoring means advantageously comprise a ventilation unit adapted to direct a stream of cooling air towards the supply and/or monitoring unit and/or towards the actuators. Thanks to this aspect of the invention, the monitoring unit and the actuators may be cooled with the same device, which is advantageous from the standpoint of reliability and cost price of the mechanism of the invention. It may also be provided that panels form or bear channels for the circulation of air for ventilating the actuators, these panels extending substantially between the plates from the ventilation unit.

The mechanism comprises a chamber for placing the cooling air from the ventilation unit under excess pressure, this chamber being in communication with the compartment and/or the channels formed or borne by the panels, through orifices made in the plate. In that case, the opposite plate is advantageously provided with orifices for the evacuation of the cooling air coming from the compartment or the channels.

The panels are inclined with respect to one another, their spaced apart relationship increasing upwardly, an opening for access to the compartment being provided at the upper edges of these panels. In that case, a removable cover for closing this opening is advantageously provided. A walkway accessing this opening may also be integrated in the structure of the loom.

The panels are formed by boxes receiving the actuators, these boxes being assembled on one another in rows and/or columns.

The invention also relates to a weaving loom equipped with a weaving mechanism as described hereinbefore. This weaving loom is simpler to use and to maintain than the looms of the prior art. Its output is substantially improved with respect to the known art and it allows the control yarn-by-yarn or by groups of several yarns of a Jacquard harness.

BRIEF DESCRIPTION OF THE DRAWINGS

The invention will be more readily understood on reading the following description of an embodiment of a weaving mechanism and a weaving loom in accordance with its principle, given solely by way of example and made with reference to the accompanying drawings, in which.

DESCRIPTION OF PREFERRED EMBODIMENT

Figure 1:
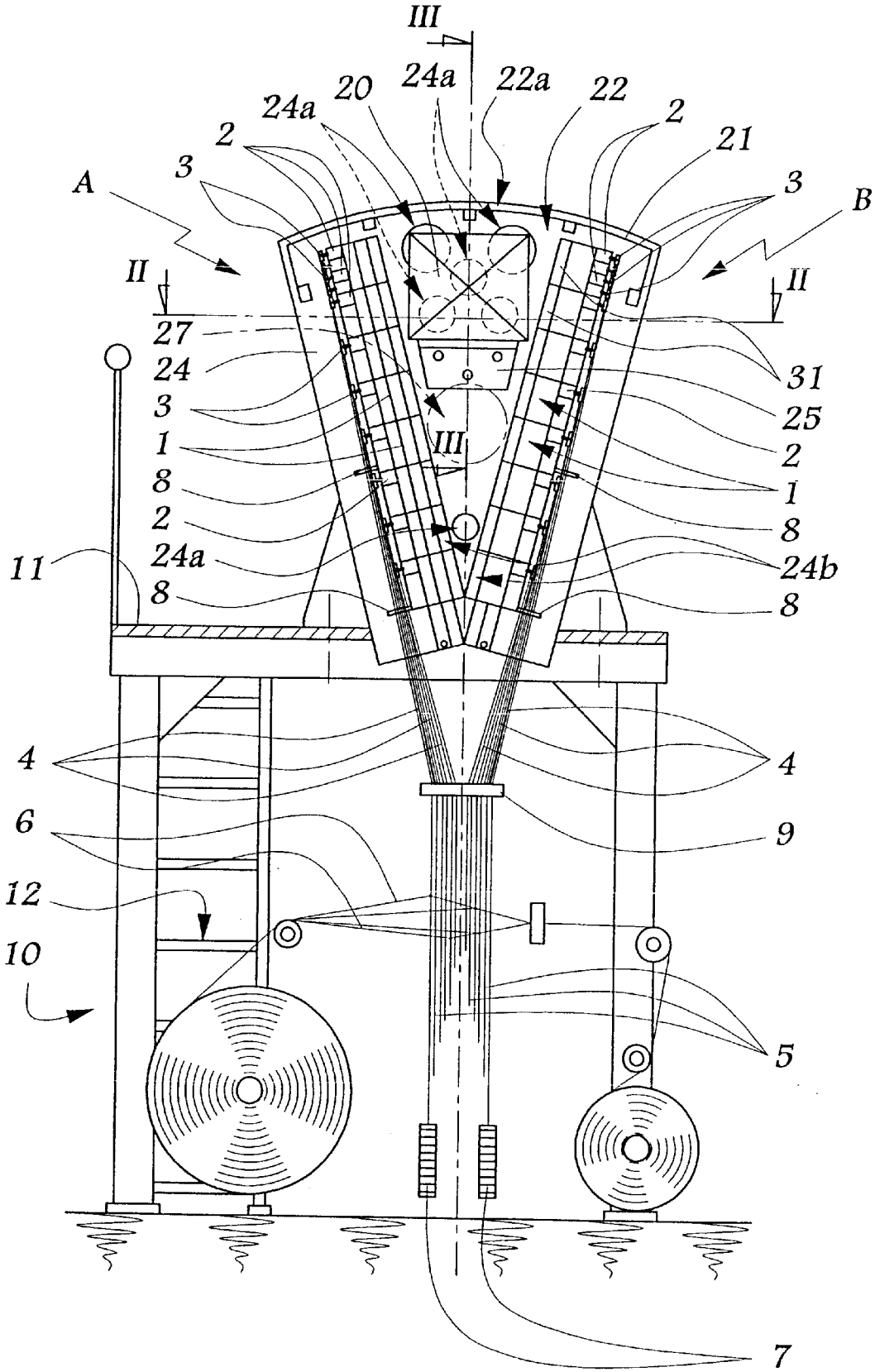
FIG. 1 is a schematic vertical section through a weaving loom according to the invention.
Figure 2:
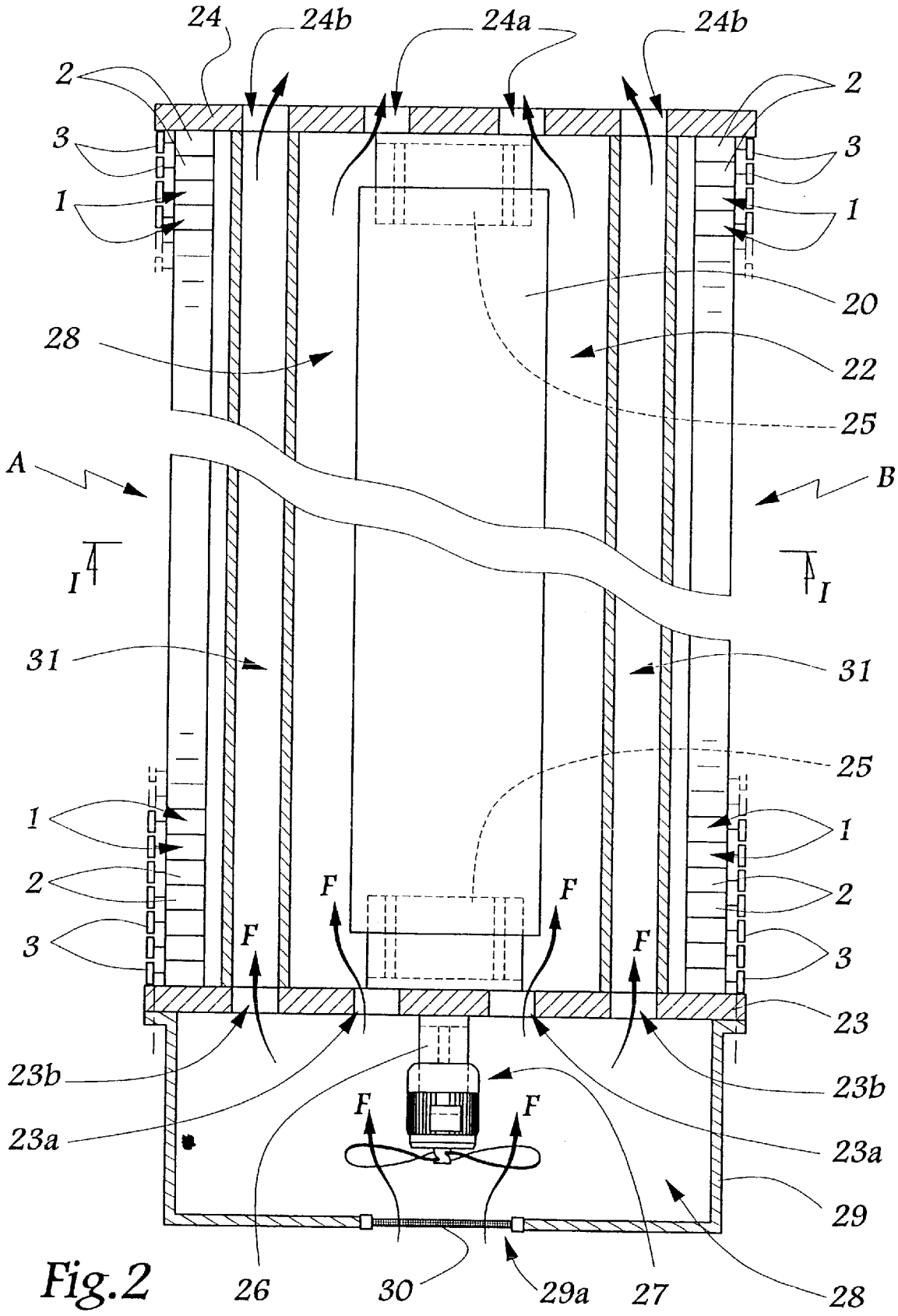
FIG. 2 is a partial section on a larger scale along line II—II in FIG. 1; I—I therein indicates the plane of section of FIG. 1.
Figure 3:
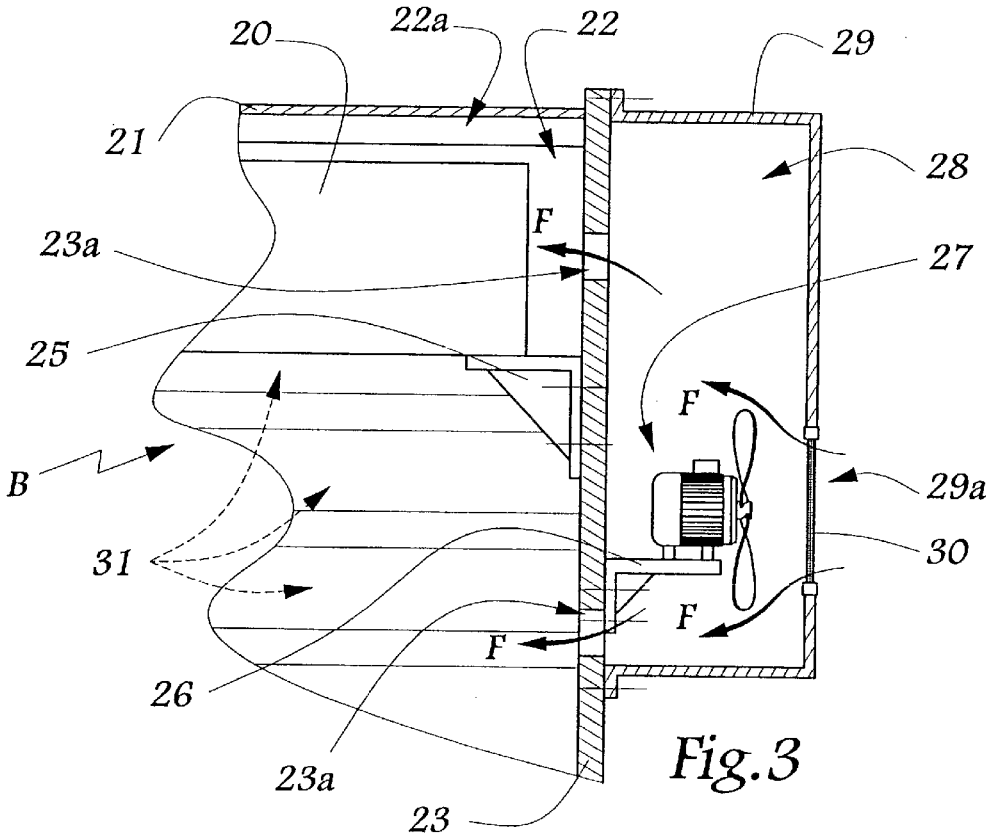
FIG. 3 is a partial section on a larger scale along line III—III in FIG. 1.
Figure 4:
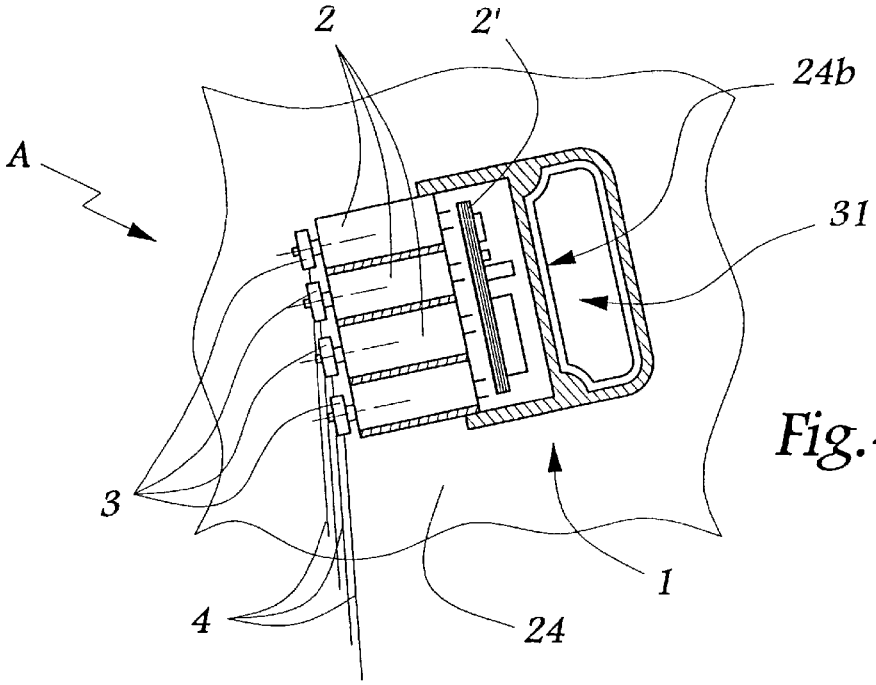
FIG. 4 is a view in detail of a box visible in FIG. 1.

Referring now to the drawings, the mechanism schematically shown in FIGS. 1 to 4 is formed by the mutual assembly of a multitude of boxes 1 of which each contains a plurality of rotary actuators 2 whose driven shaft bears a pulley 3 for winding a harness cord 4 connected to a heddle 5 intended to control the warp yarns 6 of the weaving loom. Each heddle is connected to the frame of the loom by an elastic return system 7.

The different boxes 1 are assembled in rows perpendicular to the plane of FIG. 1 and in columns parallel to this plane, with the result that they form two panels A and B disposed above the weaving area, i.e. above the loom itself. Panels A and B form an upwardly open V structure and support plates 8 for guiding the harness cords 4 so as to avoid interferences between these harness cords, while a harness board 9 is provided above the heddles 5.

A framework 10 supports the panels A and B above the loom in the configuration mentioned above. This framework comprises a walkway 11 accessible by a staircase 12.

Between panels A and B there is defined a space whose cross-section in the plane of FIG. 1 is substantially triangular and inside which is housed a unit 20 for electrical supply to and for monitoring the actuators 2.

The unit 20 comprises, inter alia, a transformer, a rectifier-regulator unit for supplying power and for supplying one or more electronic cards controlling the actuators 2. The unit 20 also comprises a battery and a stand-by battery, as well as a system of switching between the different possible sources of voltage. Unit 20 is connected by webs of conducting wires or conducting rods to the actuators 2 of each of the panels A and B. In practice, the conducting webs or rods are connected to electronic control cards 2' associated with the motors 2 in each of the boxes 1, such a card being shown only in FIG. 4.

A cover 21 covers the unit 20 and the panels A and B.

In this way, the above-mentioned space forms a compartment 22 for receiving and protecting the unit 20.

The cover 21 is advantageously mounted tightly on the panels A and B, in order to obturate the upper opening 22*a* of the compartment 22, which enables it to protect the unit 20 efficiently from the fluff of the ambient atmosphere.

Two plates 23 and 24 are provided at the ends of the compartment 22 and extend in planes substantially perpendicular to panels A and B.

The unit 20 is supported in the compartment 22 thanks to two brackets 25 respectively fixed on the plates 23 and 24.

Thanks to a bracket 26, the plate 23 also supports a ventilation unit 27 disposed inside a chamber 28 formed by a cover 29 mounted on the plate 23 and provided with an air inlet orifice 29*a* equipped with a filter 30. The unit 27 makes it possible to create an excess pressure in the chamber 28, this excess pressure being distributed towards the interior of the compartment 22 in the form of a flow of air represented by arrows F in FIGS. 2 and 3. This flow of air has the effect of cooling the unit 20 which tends to heat up due to the consumption of current. To that end, a plurality of orifices 23*a* are provided in the plate 23 for the passage of the cooling air, while corresponding orifices 24*a* are provided on the plate 24 for the cooling air to evacuate.

Channels 21 for cooling the actuators or motors 2 are also provided in the panels A and B to the rear of the actuators 2, these channels 31 being in communication with the chamber 28 thanks to specific orifices 23*b* aligned with the evacuation orifices 24*b* provided in the plate 24.

Due to the flow F of the air coming from chamber 28, an excess pressure is created in the compartment 22 and in the channels 31, which avoids the accumulation of fluff in these volumes. In order to improve heat transfer, the channels 31 may be provided with internal fins for cooling the boxes 1.

Access to unit 20 is possible by removing the cover 21 from the opening 22*a* which it obturates at the upper edges of the panels A and B. An operator who is standing on the walkway 11 may then easily proceed with operations of assembly, monitoring or maintenance of the elements constituting the unit 20, working in a satisfactory position from the ergonomic standpoint and with excellent accessibility to these elements. The walkway 11 also allows access to the actuators 2 and/or to the harness cords 4 for assembly and maintenance thereof.

The invention therefore makes it possible to increase the reliability of the interventions of an operator and to save time during assembly and maintenance of a weaving loom in accordance with its principle. In effect, most of the wirings and electrical connections may be made in the workshop and tested before being sent to the site where the loom is used, while the assembly obtained is compact, robust and economical.

What is claimed is:

1. In a weaving mechanism of Jacquard type for forming a shed in a weaving loom and which mechanism is associated with a harness including harness cords secured to heddles associated with warp yarns of the loom, the improvement comprising; two panels mounted to the loom and disposed above the heddles, a plurality of electric actuators for operatively moving the harness cords supported by said two panels, and means for controlling the operation of said plurality of electric actuators housed in a compartment defined between said two panels.

2. The weaving mechanism of claim 1 wherein two plates are mounted at opposite ends of said panels and bordering said compartment, one of said plates supporting means for monitoring the temperature of said compartment and/or said plurality of electric actuators.

3. The weaving mechanism of claim 2, wherein said temperature monitoring means includes a ventilation unit adapted to direct a current of cooling air towards said means for controlling and/or towards said plurality of electric actuators.

4. The weaving mechanism of claim 3, wherein said ventilation unit is adapted to create an excess pressure in said compartment with respect to ambient atmosphere.

5. The mechanism of claim 3, wherein each of said panels includes at least one channel for the circulation of air for ventilating said electric actuators, said channels being supplied with cooling air by said ventilation unit and extending substantially between said plates.

6. The mechanism of claim 3, wherein said ventilation unit is mounted within a chamber being in communication between said panels through orifices made in said one of said plates.

7. The mechanism of claim 3, wherein said plate opposite said one of said plates is provided with orifices for evacuation of the cooling air introduced between said panels by said ventilation unit.

8. The mechanism of claim 1, wherein said panels are inclined with respect to each other such that a space therebetween increases upwardly, an opening for access to said compartment being provided at upper edges of said panels.

9. The mechanism of claim 1, wherein said panels are formed by boxes which receive said actuators, said boxes being assembled to one another.

10. A weaving loom including a weaving mechanism of Jacquard type for forming a shed, said weaving mechanism being associated with a harness including harness cords secured to heddles, said weaving mechanism including a plurality of electric actuators for controlling movement of the harness cords, said electric actuators being supported by two panels which panels are mounted to the loom so as to be disposed above said heddles, a compartment defined between said two panels, and means for controlling the operation of said plurality of electric actuators mounted within said compartment.

11. The weaving loom of claim 10 including ventilation means for ventilating air flow through said compartment.

12. The weaving loom of claim 11 in which said two panels are formed as boxes which house said plurality of electric actuators and said boxes being inclined outwardly relative to one another toward upper portions thereof.

* * * * *